United States Patent [19]

Alskog

[11] 3,979,189

[45] Sept. 7, 1976

[54] ELECTROSTATIC FILTER

[75] Inventor: Magnus Alskog, Skara, Sweden

[73] Assignee: Aktiebolaget Lectrostatic, Skara, Sweden

[22] Filed: Jan. 29, 1975

[21] Appl. No.: 545,077

[30] Foreign Application Priority Data

Feb. 13, 1974 Sweden ..... 7401939

[52] U.S. Cl. ..... 55/131; 55/138; 55/155; 55/418; 55/DIG. 25; 55/DIG. 38

[51] Int. Cl.[2] ..... B03C 3/45

[58] Field of Search ..... 55/103, 126, 131, 155, 55/DIG. 13, DIG. 25, DIG. 38, 137, 138, 124, 129, 130, 154, 156, 418, 419; 204/188, 302

[56] References Cited

UNITED STATES PATENTS

| | | | |
|---|---|---|---|
| 1,605,648 | 11/1926 | Cooke | 55/131 X |
| 1,947,447 | 2/1934 | Brassert et al. | 55/131 X |
| 2,008,246 | 7/1935 | Deutsch | 55/138 X |
| 2,116,509 | 5/1938 | Cottrel | 204/188 X |
| 3,061,537 | 10/1962 | Yagishita | 55/131 X |
| 3,406,669 | 10/1968 | Edwards | 55/138 X |
| 3,410,057 | 11/1968 | Lerner | 55/DIG. 13 |
| 3,446,906 | 5/1969 | Zulauf | 55/DIG. 13 |
| 3,567,619 | 3/1971 | Brown | 55/155 X |
| 3,650,092 | 3/1972 | Voros et al. | 55/137 X |
| 3,655,550 | 4/1972 | Davies | 204/302 |

*Primary Examiner*—Frank W. Lutter
*Assistant Examiner*—David L. Lacey
*Attorney, Agent, or Firm*—Sughrue, Rothwell, Mion, Zinn and Macpeak

[57] ABSTRACT

An electrostatic filter for separating particles suspended in air has an electrically conducting elongate separation tube and an elongate electrode within the tube connected to a high-voltage direct current source to produce an electric charge current from the electrode to the tube. The tube has air-inlet openings distributed over the surface thereof and is covered with a layer of air-permeable material. The layer of air-permeable material is dimensioned and said air-inlet openings are dimensioned and spaced over the surface of the separation tube to to provide an air resistance such that substantially the same pressure drop of the air passing through the layer and the air-inlet openings to the interior of the separation tube along the whole length of the separation tube covered by the layer is created.

8 Claims, 2 Drawing Figures

9
15
16
3
5
2
2
6
7
10
4
1
11
11
8
II
II
17
13
12
14

ELECTROSTATIC FILTER

BACKGROUND OF THE INVENTION

The invention relates to an electrostatic filter for separating particles suspended in air, preferably for separating liquid droplets suspended in air, comprising a separation chamber having at least one elongate electrode which is arranged in the interior of the separation chamber and to which is applied a d.c. voltage from a high voltage source to produce an electric discharge current to a grounded particle seizure device.

The need for such a filter is particularly great in workshop localities in which the different machines give rise to troublesome oil mists and fogs. In the prior art, attempts have been made to remove these oil mists and fogs by venting said localities. As is well know, in order for such ventilation to be effective, a highly efficient air exchange must be achieved, which involves the use of very large fans, thereby incurring large energy costs among other things.

SUMMARY OF THE INVENTION

The object of the invention is to provide an electrostatic filter of the type before mentioned which is of simple construction and which is particularly suited for the separation of liquid particles in air, such as oil particles.

A filter constructed in accordance with the invention can be connected directly to that point on a machine where an oil mist is formed and requires but a low energy supply and no venting of air from the locality and hence the heating costs are much lower than those involved with a conventional ventilation system.

Although the main object of the invention is to provide a filter for the separation of liquid droplets, the filter may also be used to advantage for the separation of solid particles or for the separation of a combination of solid particles and liquid particles suspended in air.

BRIEF DESCRIPTION OF THE DRAWINGS

An embodiment of the invention will now be described with reference to the accompanying drawings, in which FIG. 1 is a central section through a filter and FIG. 2 shows a section through the line II—II in FIG. 1.

DESCRIPTION OF THE PREFERRED EMBODIMENT

Figure 1:
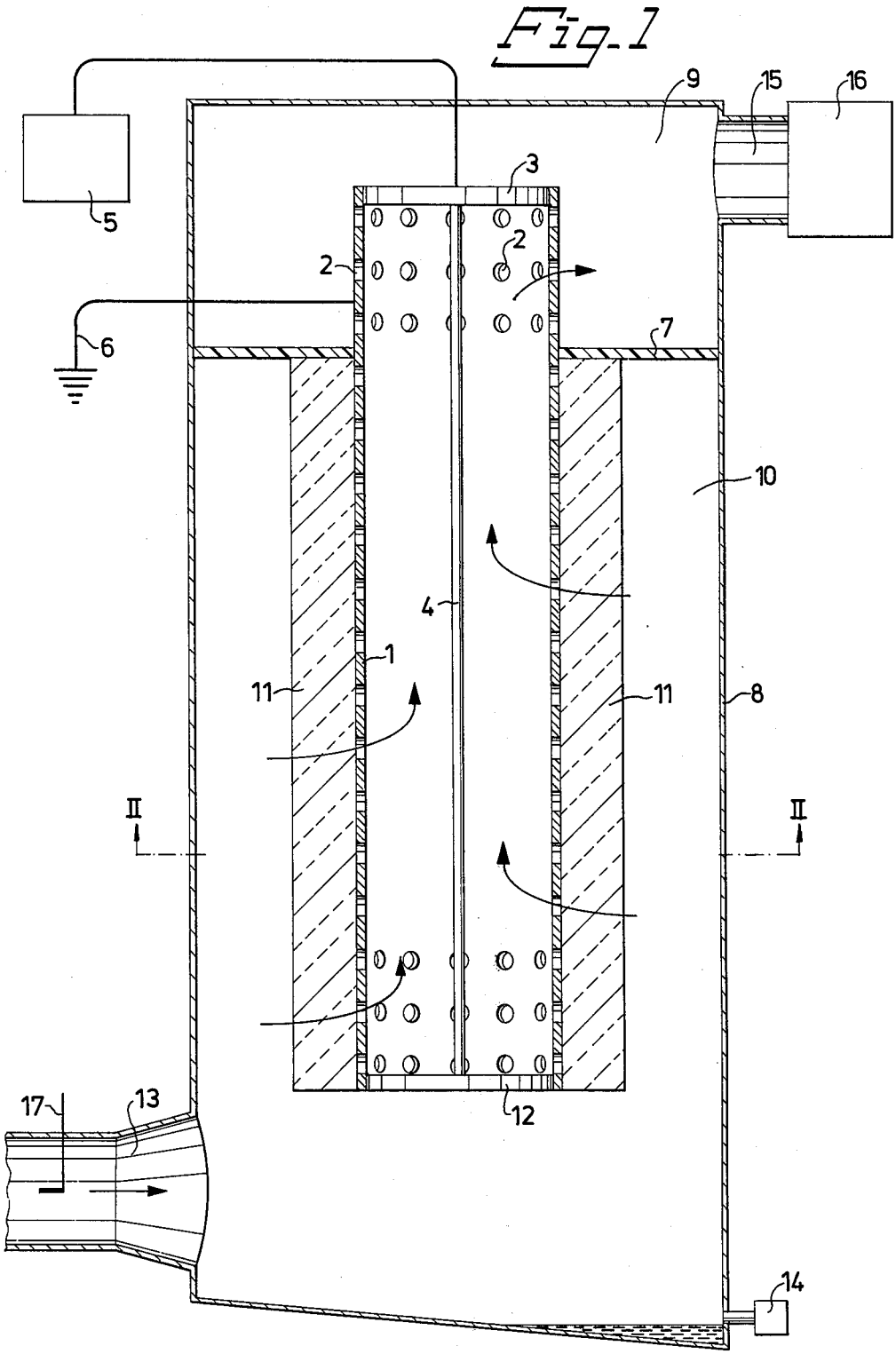
Figure 9:
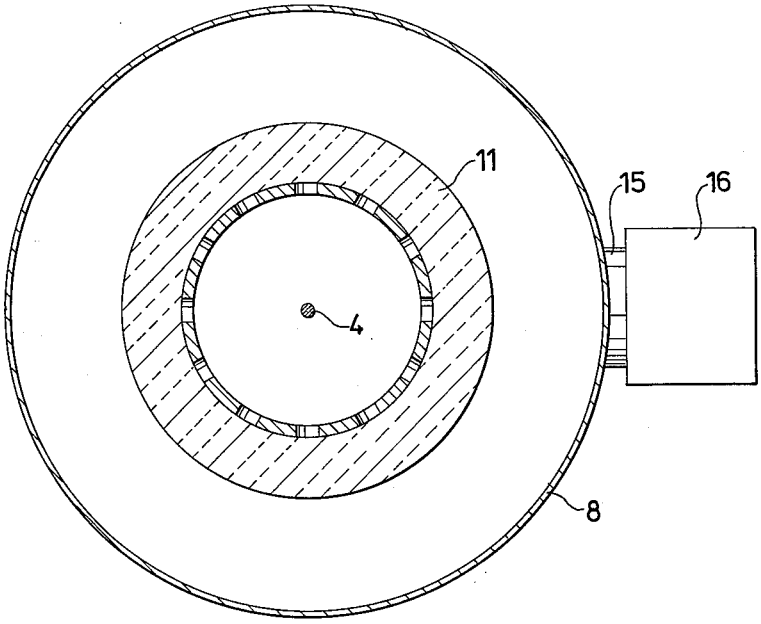

Referring to the drawings wherein like reference numerals indicate identical or corresponding structure, the reference 1 identifies an elongate tube of sheet-metal or the like which forms the separation chamber of the filter device. With the illustrated embodiment, the separation tube 1 is provided along the entire outer surface thereof with through openings 2, which may have any desired form, such as elongate slots, rectangular openings, circular openings, as shown, or openings of a different shape. The shape of the openings 2 and their distribution along the outer surface of the tube can be varied in different ways.

The separation tube 1 shown in the drawings comprises a cylinder, although it may also comprise, for example, a tube of rectangular cross-section, although the circular cross-section is preferred.

At one end, its upper end, the separation tube 2 is provided with an end wall 3, the most important purpose of which is to carry a high-voltage electrode 4 which is connected to a high-voltage source 5 which maintains the electrode at a high d.c. potential, whereby current flow is provided between the electrode 4 and the separation tube 1, said tube being connected to ground 6. The lower end of the electrode 4 is also secured in end wall 12.

The separation tube 1 is sealingly suspended in a ring-shaped disc 7, the circumference of which sealingly connects with the inner wall of a cylindrical housing 8. The cylindrical housing 8 is divided by means of the disc 7 into an upper, suction chamber 9, and a lower separation chamber 10. Extending circumferentially around that part of the separation tube 1 located in the separation chamber 10 and bearing against the outer cylindrical surface of said separation tube is a layer 11 of an air-permeable material, such as foam plastic having open cells, or a mat of fibrous material, such as a stone wool mat. The air-permeable layer 11 thus covers the openings 2 along the whole of the portion of the tube 1 located within the separation chamber. The lower end of the separation tube 1 is closed by means of an end wall 12 which seals against the tube. The end wall 12 may be replaced by a perforated disc covered with a layer of the same type of material as that from which the layer 11 is composed.

The separation chamber 10 is provided with an air-intake 13 which, with the illustrated embodiment, is located in the lower portion of the chamber, but which may also be connected to the chamber at a point located higher up. With the illustrated embodiment, the sealed bottom of the separating chamber 10 is inclined and the chamber is provided with a tapping means 14 for tapping liquid from the chamber.

The suction chamber 9 is provided with an outlet 15 which is connected to a suction source, such as a fan 16.

If so desired, a high-voltage electrode 17 can be arranged in the inlet 13, which, for example, is connected directly to a machine at that point where an oil mist or fog in generated.

The thickness of the layer 11, and therewith its air resistance, can be adapted to the suction effect and is dimensioned in dependence upon the magnitude of the openings and their distribution along the cylindrical surface of the separation tube within the separation chamber, so that substantially the same pressure drop is created in the tube 1 at its lower end as that at its upper end in the chamber 10.

The described arrangement has the following mode of operation when the high-voltage source 5 and the fan 16 have been initiated.

The fan 16 draws air through the suction chamber 9, which is assumed to be completely sealed and to communicate with the interior of the separation tube 1 via the openings 2 lying above the disc 7. As a result of the lower pressure prevailing in the interior of the separation chamber 1, air is sucked from the inlet 13, through the separation chamber 10, through the air-permeable layer 11 and the openings 2 located on the inside of the layer in the wall of the separation tube 1, there being thus created an air flow from the inlet 13 to the suction chamber 9 and the fan 16. The air flow, which is illustrated in FIG. 1 by means of arrows, is assumed to contain small droplets of oil and/or other liquid or solid particles. Since the pressure drop is substantially constant from the upper to the lower end of that part of the separation tube 1 located within the separation chamber 10, substantially the same amount of air will flow in through the layer within each surface unit of said layer, and said layer is thus uniformly loaded with contaminated air.

The electrode current produced by the electrode 4 arranged centrally in the tube 1 passes radially towards the inner wall of the separation tube 1 and along the whole of the part of the separation tube located in the separation chamber 10.

A large number of electrons thus flow out through the openings 2 in the separation tube 1 and meet the oil droplets within the layer 11, as said droplets are sucked through said layer, whereupon the oil droplets are charged and are precipitated out onto the outside of the separation tube 1, and run along said tube collect gradually at the bottom of the housing 8. The collected oil can then be tapped off via the valve 14.

The oil particles which penetrate the holes in the wall of the separation tube 1 and are transported by the air flow towards the electrode 4 meet a progressively denser electron flow and the movement direction of such particles is changed before they reach the electrode, thereby preventing said particles from fouling the electrode. The particles or oil droplets will then be precipitated onto the tube 1. If oil is precipitated onto the inside of the tube, the oil is collected on the end wall 12, provided that said end wall is completely sealed, and consequently tapping means should be arranged in said end wall.

When a high-voltage electrode 17 according to FIG. 1 is used, the particles will be charged before they meet the flow of electrons from the electrode 4, and therewith oil droplets are effectively prevented from penetrating the interior of the separation tube.

Owing to the fact that, in accordance with the invention, oil is prevented from reaching the electrode 4, the fire risk normally present with oil filters is eliminated.

If the layer 11 is sufficiently self-supporting, the separation tube 1 may have the form of a perforated metal foil attached to the inner surface of the layer 11.

The illustrated device can be modified in different ways within the scope of the claims. Thus, it is possible to allow the separation tube 1 to discharge freely into the suction chamber 9, i.e. the whole of the tube 1 lying above the disc 7 can be omitted. It is also possible to provide more than one high-voltage electrode 4 in the separation tube and, furthermore, a plurality of separation tubes can be arranged in one and the same housing 8, if so desired.

It should be observed that the housing 8 need only be used if direct suction of contaminated air from a determined site is to be effected.

Thus, it is possible to arrange one or more tubular units freely in a locality containing contaminated air and to connect the fan 16 directly to the outlet end of the separation tube.

The air-permeable layer 11 may comprise an electrically-conductive material, such as steel wool, although a non-conducting material is preferably used, since the seizure of the charged particles thereby takes place on the cylindrical surface of the tube 1, from which they can readily be removed.

Although the separation tube 1 is shown to extend vertically in the drawing, thereby facilitating the running of oil along the tube, said tube may be arranged in any position whatsoever.

If the air drawn into the device contains harmful or ill-smelling gases, the layer 11 may be impregnated with a suitable reaction substance which eliminates the effect of such gases.

It should be observed that although a suction fan is used with the illustrated embodiment, the air or gas can equally well be blown through the filter.

It will, therefore, be apparent that the embodiment specifically illustrated is only exemplary and that various modifications can be made in construction and arrangement within the scope of the invention as defined in the appended claims.

I claim:

1. An electrostatic filter for separating solid particles or liquid particles or a combination of both suspended in air, comprising:

an electrically conducting, elongate separation tube having air-inlet openings distributed over the surface thereof, said separation tube being open at one end and closed at the other end by an end wall, at least one elongate electrode positioned within said separation tube in spaced relation thereto, a high-voltage direct current source connected across said separation tube and said at least one elongate electrode to produce an electric charge current from said electrode to said separation tube, a layer of air-permeable material on the outer surface of said separation tube covering all of said air-inlet openings, a housing having an air-intake opening at one end thereof and an air-outlet opening at the other end thereof, said separation tube being supported within said housing by sealing means transversely dividing the interior of said housing into a suction chamber and a separation chamber with the open end of said separation tube communicating with the suction chamber having the air-outlet opening and the remainder of said separation tube projecting into the separation chamber having the air-intake opening, and suction means connected to the air-outlet opening of said housing for drawing air into said separation tube through said layer of air-permeable material and said air-inlet openings, said layer of air-permeable material being dimensioned and said air-inlet openings being dimensioned and spaced over the surface of said separation tube to provide an air resistance such that substantially the same pressure drop of the air passing through said layer and said air-inlet openings to the interior of said separation tube along the whole of the length of said separation tube covered by said layer is created.

2. An electrostatic filter according to claim 1, wherein said end wall comprises an air impermeable disc.

3. An electrostatic filter according to claim 1 wherein said separation tube is made of metal.

4. An electrostatic filter according to claim 1 wherein said air-permeable material comprises a foam plastic material with open cells.

5. An electrostatic filter according to claim 1 wherein said air-permeable material comprises mineral wool fibres.

6. An electrostatic filter according to claim 1 wherein the open end portion of said separation tube projects into the suction chamber having the air-outlet opening and has free air-outlet openings disposed over the surface of said separation tube.

7. An electrostatic filter according to claim 1, wherein said separation tube is arranged substantially vertically in said housing and that the lower end of said housing cooperates with means for collecting liquid particles precipitated onto the surface of said separation tube.

8. An electrostatic filter according to claim 1 further comprising means in said air-intake opening for electrostatically charging particles in the air passed to said separation chamber.

* * * * *